United States Patent [19]

Bezubik et al.

[11] 4,232,857

[45] Nov. 11, 1980

[54] MACHINE VISE

[75] Inventors: Sławomir J. Bezubik; Stanislaw Laszcz, both of Bialystok, Poland

[73] Assignee: Fabryka Przyrzadow i Uchwytow PONAR-BIAL Zaklad Nr 1-Wiodacy, Bialystok, Poland

[21] Appl. No.: 47,825

[22] Filed: Jun. 6, 1979

[30] Foreign Application Priority Data

Jun. 17, 1978 [PL] Poland ..... 207728

[51] Int. Cl.[3] ..... B25B 1/12

[52] U.S. Cl. ..... 269/212; 269/244

[58] Field of Search ..... 269/165, 207-215, 269/240, 244, 247, 110

[56] References Cited

U.S. PATENT DOCUMENTS 587,749 8/1897 McKenzie ..... 269/247

1,766,230 6/1930 Sea ..... 269/208

FOREIGN PATENT DOCUMENTS 16258 of 1907 United Kingdom ..... 269/110

*Primary Examiner*—Robert C. Watson

*Attorney, Agent, or Firm*—Haseltine, Lake & Waters

[57] ABSTRACT

Machine vise for clamping workpieces in machine tools characterized by that it has movable strip (3) situated in the vise body guides terminated with a stationary jaw (2). The said strip has thrust recesses (4) a row of its top surface. The securing catch (5) of movable jaw (6) enters these recesses. In the bottom part of the movable strip there is a threaded hole (7) coacting with the vise lead screw (8). The securing catch (5) is in contact with the driving unit (9) secured in a proper position by the known securing member (10).

1 Claim, 2 Drawing Figures

MACHINE VISE

BACKGROUND OF THE INVENTION

This invention relates to a machine vise applicable for clamping workpieces on machine tools.

Those skilled in the prior state of art know some other machine vise designs and, particularly, designs featured with the application of a short screw for shifting the movable machine vise jaw presented in the British Pat. No. 674,063, U.S. Pat. No. 3,630,512, and the GRF Pat. specification No. 1,289,498.

In the above mentioned designs, the effect of application of relatively short clamping screw in order to widen component size range has been obtained by shifting the movable jaw together with the screw over some segments and securing it by means of suitable pins or shoulders in the vice body. However, the designs mentioned above have many drawbacks because they require either removal of the pins securing the movable vice jaw at a given position, or a displacement of the whole movable jaw unit together with the clamping screw which is not enclosed and thus exposed to damaging and impurities.

SUMMARY OF THE INVENTION

The object of this invention has been such a machine vice design which would obviate the above mentioned drawbacks and would render possible to clamp relatively easily workpieces of various sizes within a considerable size range and protecting simultaneously the clamping screw againts the possible damaging of thread and impurities.

This aim has been achieved by a machine vice design provided with a movable strip situated in body guides and terminated with stationary jaw. On the top surface of the strip there is a row of thrust recesses. The securing catch of movable jaw enters these recesses. In the bottom part of the movable strip there is a threaded hole coacting with the vice lead screw. The securing catch is in contact with the driving member secured in a proper position by the known securing member.

When using the above presented machine vise it is possible to quickly change the clamping range and to considerably shorten auxiliary times when working on the machine.

Still another advantage of the present design is its greater working range due to considerable spacing of vice jaws. Also the service life of machine vise is considerably prolonged because the vice is protected against chips, impurities and damage. The present design also imposes no restrictions on the kind of the drive being used. The machine vise presented above can have either hand drive, or an electric pneumatic or hydraulic drive.

IN THE DRAWINGS

The invention will be presented by way of an example of embodiment.

DISCUSSION OF INVENTION

Figure 1:
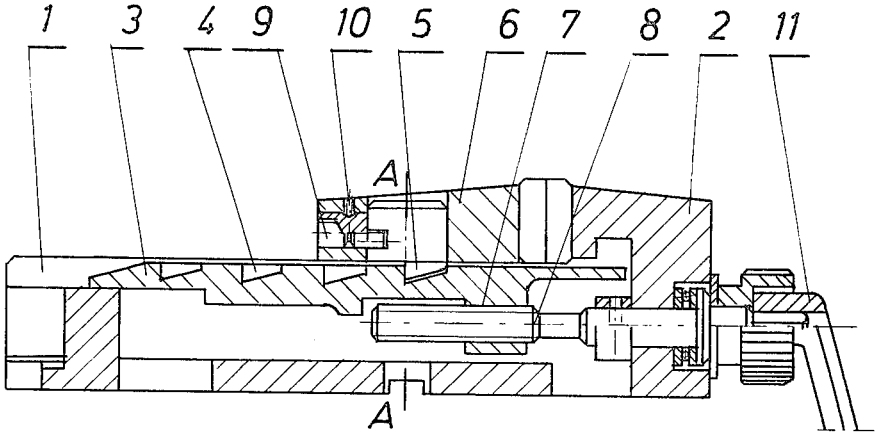
FIG. 1 shows the vice in longitudinal section.
Figure 2:
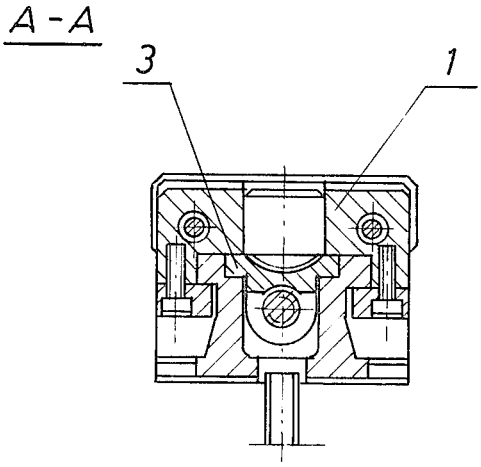
FIG. 2 is a cross section of FIG. 1 at A—A.

The machine vice has a body terminated with stationary vise 2. In the body there are guides 1 in which the movable strip 3 moves. In the top surface of this strip 3 there is a row of thrust recesses 4.

A securing unit 5 is located in the movable jaw 6 entering the thrust recesses 4. The movable strip 3 has a threaded hole 7 in its bottom part coacting with the lead screw 8 secured by means of a hand lever 11. The securing catch 5 is connected movably with the driving unit 9 which has a circular shape and an eccentrically located end-piece is protected by means of a threaded pin 10.

The securing unit 5 has on its lateral surface, a transverse channel where an eccentric protrusion in a form of a pin projects from the front of the driving unit 9 and is slidably located thereat. On the opposite front, the driving unit 9 possesses a nest for a mandrel spanner. The circumference of the cylindrical surface of the driving unit 9 is provided with the above mentioned channel, whereto a cylindrical tip of the threaded pin 10 is screwed into a threaded opening of the jaw 6.

The action of the vise according to the invention is as follows: in order to move the movable jaw 6 at the desired distance the driving unit 9 is rotated by the mandrel spanner. During rotation, the eccentric protrusion located on the front of the driving unit 9 upwardly changes its location in relation to the axis of the driving unit 9 and slides into the transverse channel of the catch 5 and thereby upwardly moves the catch 5 to cause its withdrawal from a thrust recess 4 of a movable strip 3. Successively the movable jaw 6 is being shifted on the guides 1 over the other recess 4 and the catch 5 is lowered by means of turning the driving unit 9 in the opposite direction of about 180°.

Once the preliminary vice jaw is set clamp the workpiece by revolving the lead screw 8 by means of a hand crank 11. Lead screw 8 coacting with the threaded hole 7 shifts the movable strip 3 with the movable jaw 6 meshed with it, by means of catch 5 and thrust recess 4.

We claim:

1. A machine vise apparatus having a body, a stationary jaw disposed at a terminus of said body, guide means disposed in said body having a movable strip formed of a movable jaw, adapted to cooperate therewith and move in said guide means, and a lead screw for registration with said movable strip, said apparatus comprising: a series of thrust recesses formed on the upper surface of said movable strip, a securing catch disposed in said movable jaw whereby, said recesses accommodate said securing catch which is in mesh with a driving means, and a threaded hole formed at the lower surface of said movable strip, adapted to cooperate with said lead screw.

* * * * *